United States Patent [19]

Santo

[11] Patent Number: 4,675,929

[45] Date of Patent: Jun. 30, 1987

[54] COMPACT COLLAPSABLE FLOATATION SLEEP SURFACE PEDESTAL AND CONTAINER THEREFOR

[76] Inventor: Phillip J. Santo, 12 Mountain Rd., Rochester, N.Y. 14625

[21] Appl. No.: 712,629

[22] Filed: Mar. 18, 1985

[51] Int. Cl.[4] ..... A47C 19/00

[52] U.S. Cl. ..... 5/400; 5/282 R; 5/285; 5/308; 108/64; 108/114; 312/111; 403/217

[58] Field of Search ..... 5/400, 401, 285, 282 R, 5/308; 312/111; 108/64, 114; 403/217; 190/2

[56] References Cited

U.S. PATENT DOCUMENTS

| | | | |
|---|---|---|---|
| 14,660 | 4/1856 | Hinman | 5/285 |
| 270,661 | 1/1883 | Hall | 5/285 |
| 468,704 | 2/1892 | Snaman | 190/2 |
| 2,101,573 | 12/1937 | Cramer et al. | 108/64 |
| 2,783,107 | 2/1957 | Gacht | 108/64 |
| 4,110,854 | 9/1978 | Sjolie | 5/308 |
| 4,205,405 | 6/1980 | Hagney | 5/37 R |
| 4,319,370 | 3/1982 | Robinson | 5/400 |
| 4,507,815 | 4/1985 | Danko | 5/400 |

FOREIGN PATENT DOCUMENTS

| | | | |
|---|---|---|---|
| 1040259 | 10/1953 | France | 108/114 |

*Primary Examiner*—Alexander Grosz

*Attorney, Agent, or Firm*—Lawrence P. Kessler

[57] ABSTRACT

A pedestal for a floatation sleep surface, such pedestal being collapsable into a compact arrangement for convenient storage and ready transportation in a manually manipulable container. The pedestal comprises a plurality of generally rectangular members, a plurality of support legs, and connectors, all adapted to be stored in a manually transportable container. The members include locators at preselected positions for locating support legs. When the support legs are attached to the locators of the rectangular members, the rectangular members are interconnected by the connectors to form a unitary pedestal arrangement of a size sufficient to support a particular size floatation sleep surface.

5 Claims, 11 Drawing Figures

COMPACT COLLAPSABLE FLOATATION SLEEP SURFACE PEDESTAL AND CONTAINER THEREFOR

BACKGROUND OF THE INVENTION

This invention relates generally to a pedestal for a floatation sleep surface, and more particularly to a compact collapsable floatation sleep surface pedestal and a storage container therefor.

It is the general practice to support floatation sleep surfaces (fluid filled bladders) on pedestals. A pedestal typically includes a plurality of upstanding substantially parallel rigid members interconnected by substantially parallel cross-members forming an open-celled box-like structure. A platform is in turn supported on such structure. The platform forms the support for the floatation sleep surface, distributing its weight over a larger area than would be the case with perimeter frames for conventional sleep system. Like conventional sleep systems, floatation sleep surfaces are available in a variety of sizes. Thus, the pedestals must also be available in such sizes.

Pedestals of the described type have presented some fundamental problems to the floatation sleep industry. Due to variety of sizes of the pedestals and their construction, considerable storage space is required by the retailer of floatation sleep systems. Moreover, due to their size and weight, shipping costs from point of manufacture to the retailer are expensive; and, delivery to the end user and set-up requires a relatively large vehicle and considerably manual labor. One attempt to simplify floatation sleep surface pedestal constructure is shown in my U.S. Pat. No. 4,224,705 issued Sept. 30, 1980. While this pedestal is collapsable for storage and adjustable for accommodating different size sleep surfaces, it still has considerable weight and is of a large overall size. Moreover, it cannot accommodate a drawer system often desired by users in their floatation sleep systems.

SUMMARY OF THE INVENTION

This invention is directed to a pedestal for a floatation sleep surface, such pedestal being collapsable into a compact arrangement for convenient storage and ready transportation in a manually manipulable container. The pedestal comprises a plurality of generally rectangular members, a plurality of support legs, and connectors, all adapted to be stored in a manually transportable container. The members include locators at preselected positions for locating support legs. When the support legs are attached to the locators of the rectangular members, the rectangular members are interconnected by the connectors to form a unitary pedestal arrangement of a size sufficient to support a particular size floatation sleep surface.

The invention, and its objects and advantages, will become more apparent in the detailed description of the preferred embodiments presented below.

BRIEF DESCRIPTION OF THE DRAWINGS

In the detailed description of the preferred embodiments of this invention, reference is made to the accompanying drawings, in which.

DESCRIPTION OF THE PREFERRED EMBODIMENTS

Figure 1:
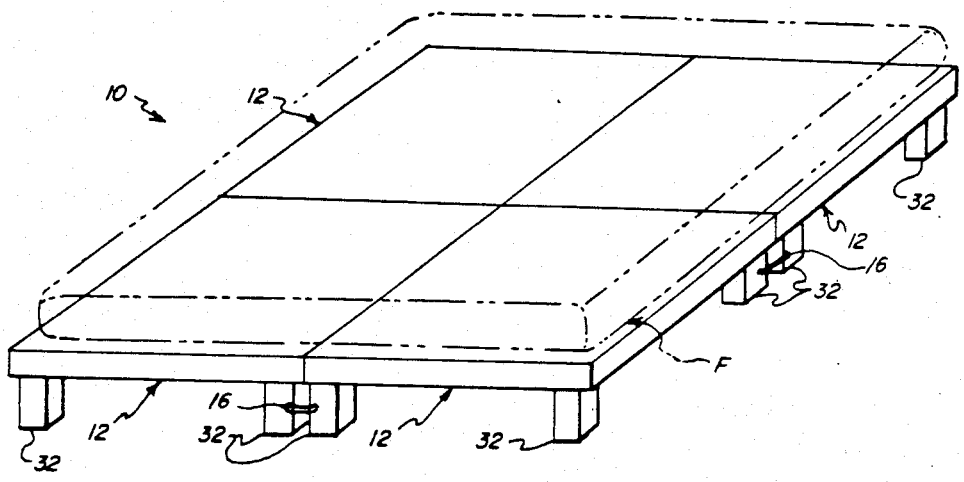
FIG. 1 is a view in perspective of an assembled compact collapsable pedestal, for a floatation sleep surface (shown in phantom), according to this invention.
Figure 2:
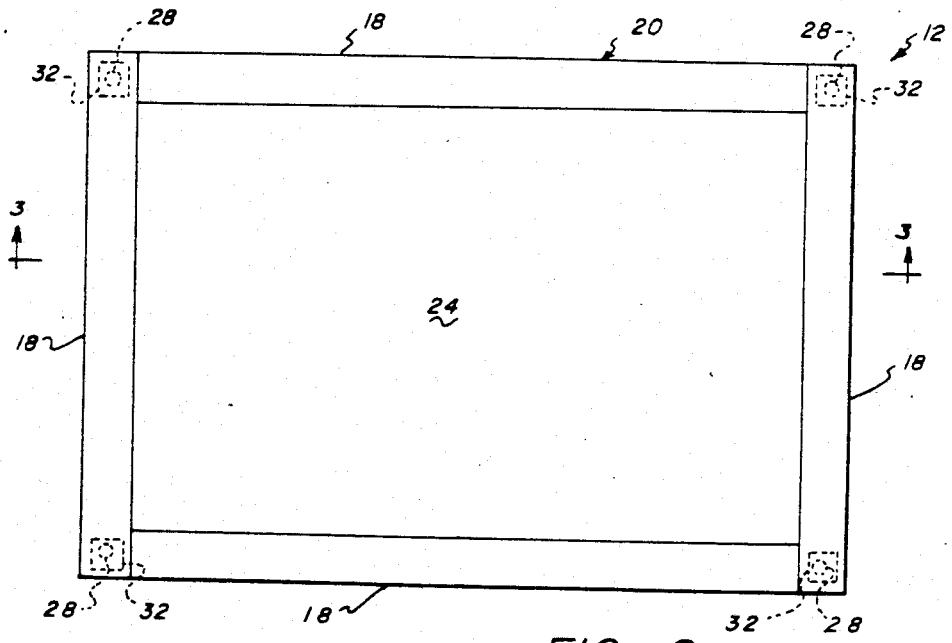
FIG. 2 is a top plan view, on an enlarged scale, of a rectangular member of the pedestal of FIG. 1.

Referring now to the accompanying drawings, an assembled compact collapsable pedestal according to the invention is designated generally by the numeral 10. The pedestal 10 comprises a plurality of rectangular members 12 supported on legs 32 and interconnected by connectors 16 to form a unitary arrangement for supporting a floatation sleep surface F (shown in phantom in FIG. 1). The rectangular members 12 respectively include opposing pairs of side members 18 joined together to form a rectangular frame 20 (see. FIG. 2). The side members 18 each have a groove 22 (see FIG. 3). A filler panel 24, having a peripherally formed tongue 26, is supported in the grooves 22 of the members 18 of frame 20.

Figure 3:
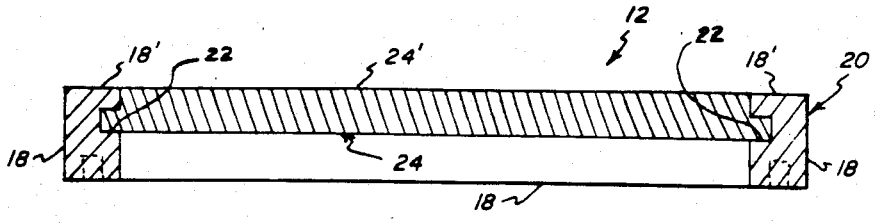
FIG. 3 is a side elevational view, in cross-section, of the rectangular member taken along lines 3—3 of FIG. 2.
Figure 4:
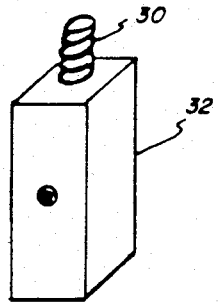
FIG. 4 is a side elevational view on an enlarged scale, of an exemplary support leg of the pedestal of FIG. 1.

The location of the grooves 18 and the dimensions of the tongues 26 of the panels 24 are selected so that receipt of the tongues 26 in the grooves 22 result in the surfaces 24' of the panels 24 being coextensive with the surfaces 18' of their respective supporting side members 18 (see FIG. 3). In this manner, the coextensive surfaces (24' and 18') of adjacent assembled rectangular member 12 form a substantially flat plane adapted to support a floatation sleep surface (shown in phantom in FIG. 1). By this arrangement the overall weight of the rectangular members 12 is reduced when compared to prior platforms formed of a single solid construction. The reduced weight has significant advantages in that it facilitates transport of the pedestal in its stored condition as described hereinbelow. Of course other structural arrangements for the rectangular members 12, providing reduced weight and a flat plane for supporting a floatation sleep surface, are suitable for use with this invention.

The rectangular members 12 have locators 28 spaced at preselected positions on the side members 18. The locators 28 may be, for example, drilled and threaded holes for receiving complementary threaded dowels 30 of support legs 32. The support legs 32, which may be of any suitable cross-section, are formed to be of a uniform length. Assembly of the support legs 32 to the rectangular members 12 at the proper location can thus be readily accomplished by unskilled labor, yet will result in the assembly being of proper configuration to be used in a pedestal (i.e., with all rectangular members being of the same height).

The overall dimensions for a rectangular member 12 are selected to be a predetermined fraction of the size of typical conventional floatation sleep surfaces. Therefore, a combination of a number of rectangular members results in a pedestal for a particular conventional size floatation sleep surfaces. For example, the dimensions of a rectangular member may be one meter by one and one half meters. With these dimensions a pedestal arrangement comprising two rectangular members, mated along the one meter edge, measures one meter by three meters, or the size of the smallest conventional floatation sleep surface referred to as a "single". Similarly, rectangular members mated in a two-by-two pedestal arrangement measure two meters by three meters, or the size of a conventional size floatation sleep surface referred to as a "queen". And, rectangular members mated in a two-by-three pedestal arrangement measure three meters by three meters, or the size of conventional size floatation sleep surface referred to as a "king".

Figure 5:
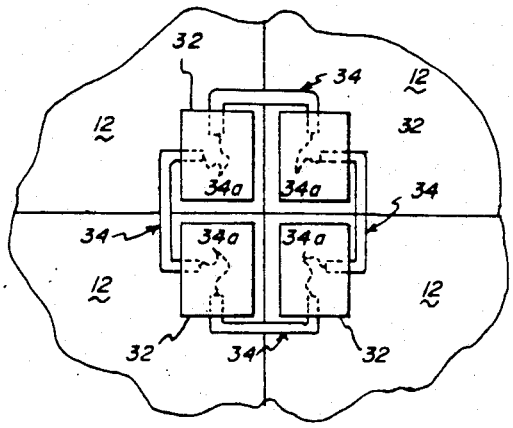
FIG. 5 is a bottom plan view of a portion of the assembled compact collapsable pedestal according to this invention showing the connector for adjacent rectangular members.
Figure 6:
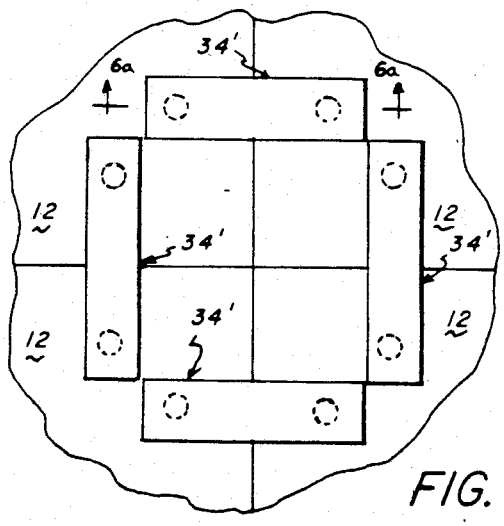
FIG. 6 is a top plan view of a portion of the assembled compact collapsable pedestal showing an alternative connector for adjacent rectangular members.
Figure 6A:
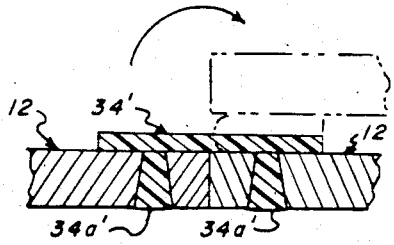
FIG. 6*a* is a side elevational view, in cross-section, of the pedestal portions and connector of FIG. 6, taken along lines 6*a*—6*a;*

The various described pedestal arrangements are made by interconnecting the rectangular members 12 with connectors 34 shown in FIG. 5, or alternatively the connectors 34' shown in FIGS. 6, 6*a*. The connectors 34 are substantially rigid U-shaped members. Portions 34*a* of the connectors 34 are adapted to be received in bores formed in the legs 32 fixed to adjacent rectangular members to hold the members in substantially rigid alignment. Connectors 34' are substantially flexible straps having outwardly tapering legs 34*a'*. The legs 34*a'* are adapted to be secured in bores formed in panels 24 of adjacent rectangular members. The straps hold the members in substantially rigid alignment when arranged in a pedestal and allow two such adjacent members to be folded together (see phantom view of FIG. 6*a*) for storage. Of course, other types of connectors which hold the rectangular members in a substantially rigid assembly to form the desired pedestal arrangement are suitable for use with this invention.

Figure 7:
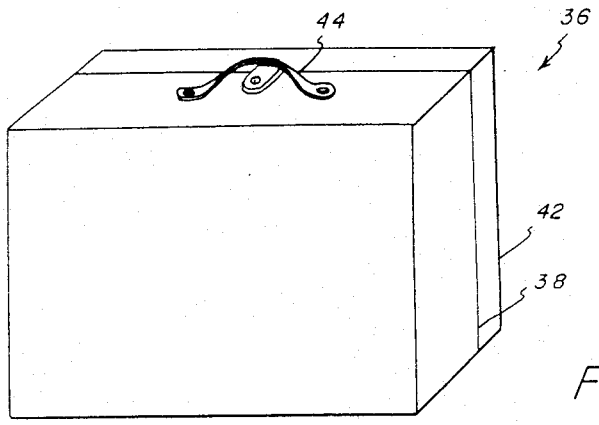
FIGS. 7 and 8 are views in perspective of the container for the compact collapsable pedestal according to this invention respectively showing such container closed and open.
Figure 8:
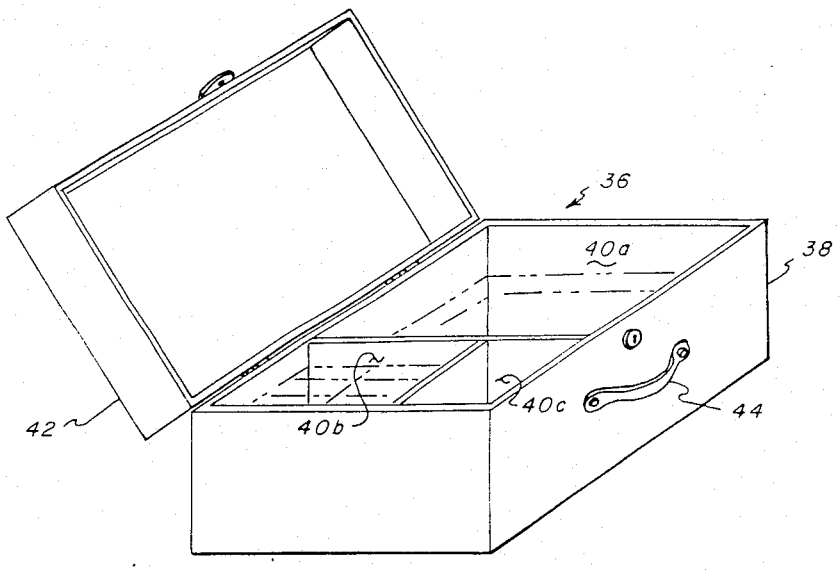

The rectangular members 12 of the above-described exemplary dimensions are also of a suitable size for convenient storage and transportation. Storage and transportation are accomplished in a container 36 shown in FIGS. 7 and 8. The container 36 has a body 38 divided, for example, into chambers 40*a*, 40*b*, and 40*c* respectively sized to house the rectangular members 12, support legs 32, and connectors 34. A hinged lid 42 is coupled to the body 38 along a marginal edge and forms a closable cover for the body. Further, the body 38 has a handle 44 which enables the container, and its contents, to be readily manually handled. The container 36 thus provides for easy transport from one location to another and storage in a compact space. This presents significant advantages for both the manufacturer and retailer of floation sleep systems, as well as the end user (customer). The manufacturer and retailer save on storage space and shipping costs, while the end user is provided with a convenient transport container for an easily assemblable pedestal.

Figure 10:
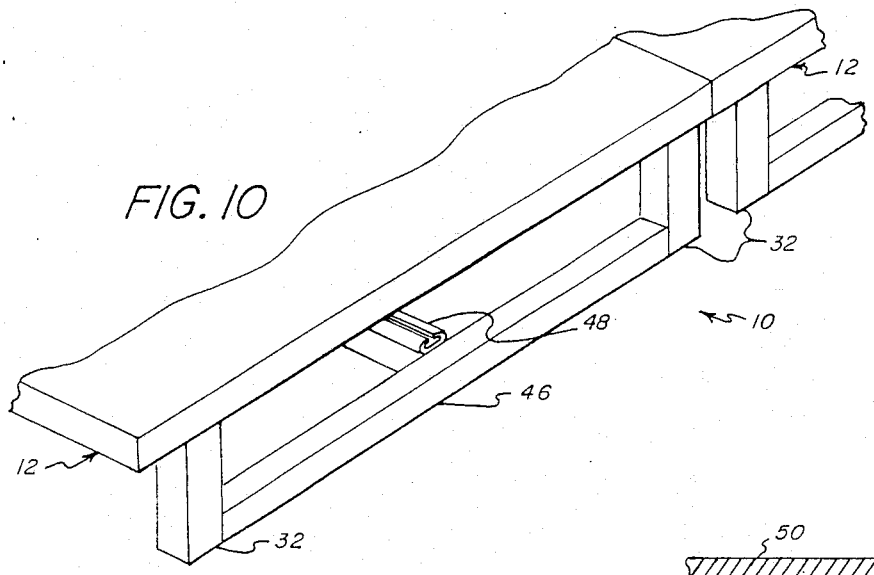
FIG. 10 is a side elevational view, partly in cross-section of the pedestal as modified in FIG. 9 to include storage drawers.
Figure 11:
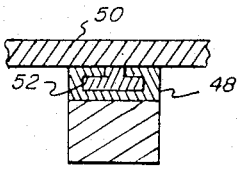
FIG. 11 is a cross-sectional view, on an enlarged scale, of a drawer guide and slide construction taken along lines 11—11 of FIG. 9.
Figure 9:
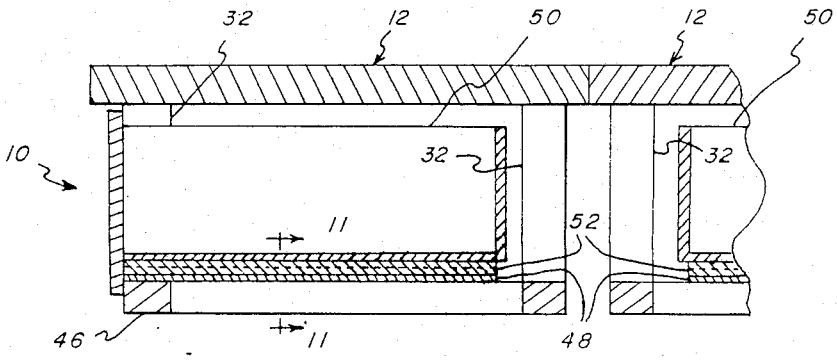
FIG. 9 is a view, in perspective, of a portion of the compact collapsable pedestal, according to this invention, as modified to accommodate storage drawers.

As mentioned above, it is often desirable to include a storage drawer system in a pedestal for a floatation sleep surface. The heretofore described pedestal 10 is readily convertable for accepting such a storage drawer system. As shown in FIGS. 9 and 10, to accommodate the storage drawer system, support members 46 is connected to outboard legs 32 of an assembled pedestal. Central drawer guides 48, corresponding to the number of drawers for the system, are fixed to the support members 46 and extend across the interior of the pedestal at locations which determine the locations of the drawers. The drawers 50 respectively have slides 52 which cooperate with the guides 48 (see FIGS. 10 and 11) to enable the drawers to be moved relative to the pedestal for access. Of course other suitable arrangements could be substituted for the described guide and slide construction for drawer movement. Further, the container 36 may include additional chambers for housing the support members 46 and guides 48, and even drawers 50 if disassembled. Therefore, the pedestal arrangement including the storage drawer system is also suitable for ready transport in a convenient container.

The invention has been described in detail with particular reference to a preferred embodiment thereof, but it will be understood that variations and modifications can be effected within the spirit and scope of the invention.

I claim:

1. A compact, storable pedestal for supporting a floatation sleep surface, said pedestal comprising:

a plurality of generally rectangular members adapted to be stored in a manually transportable container, said members respectively including means located at preselected positions for locating rectangular member support legs;

a plurality of removable, rectangular member support legs adapted to be stored in such container, said legs respectively including means for attaching said legs to said locating means; and means, adapted to be stored in such container, for interconnecting said rectangular members into a unitary pedestal arrangement of a size sufficient to support a floatation sleep surface when said legs are attached to said locating means, said interconnecting means including fasteners adapted to be coupled to said legs for joining adjacent ones of such legs.

2. The invention of claim 1, wherein said rectangular members respectively include a plurality of elongated members interconnected end-to-end to form a frame, and a planar member attached to said elongated members within such frame.

3. The invention of claim 1 including means, adapted to be stored in such container, for slidably supporting a drawer assembly in association with said interconnected rectangular members.

4. A compact, collapsable pedestal for supporting a floatation sleep surface and manually transportable means for storing such pedestal in its collapsable condition comprising:

a container of substantially rectangular cross-section, said container including handle means attached thereto for manually transporting said container;

a plurality of generally rectangular members of a size sufficient to be readily received within said container, said members respectively including means at preselected positions for locating rectangular member support legs;

a plurality of removable, rectangular member support legs adapted to be stored in such container, said legs respectively including means for attaching said legs to said locating means; and connector means, of a size sufficient to be readily received within said container, for interconnecting said rectangular members into a unitary pedestal arrangement of a size sufficient to support a floatation sleep surface when said legs are attached to said locating means, said interconnecting means including fasteners adapted to be coupled to said legs for joining adjacent ones of such legs.

5. The invention of claim 4 including means, of a size sufficient to be readily received within said container, for slidably supporting a drawer assembly in association with said interconnected rectangular members.

* * * * *